US007868274B2

(12) United States Patent
Bohme et al.

(10) Patent No.: US 7,868,274 B2
(45) Date of Patent: Jan. 11, 2011

(54) THERMALLY ACTIVATABLE MICROWAVE INTERACTIVE MATERIALS

(75) Inventors: Reinhard Bohme, Vancouver, WA (US); John Cameron Files, Vancouver, WA (US); Terrence P. Lafferty, Winneconne, WI (US); Scott W. Middleton, Oshkosh, WI (US); Richard G. Robison, Appleton, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 490 days.

(21) Appl. No.: 11/404,325

(22) Filed: Apr. 14, 2006

(65) Prior Publication Data

US 2006/0289521 A1 Dec. 28, 2006

Related U.S. Application Data

(60) Provisional application No. 60/671,267, filed on Apr. 14, 2005.

(51) Int. Cl.
*H05B 6/80* (2006.01)

(52) U.S. Cl. ..... 219/730; 219/725; 219/726; 219/727; 219/728; 219/729

(58) Field of Classification Search ..... 219/725–735, 219/759, 730, 10.55 F, 125.35, 903, 10.55 E; 99/DIG. 14; 426/107, 234, 241, 243
See application file for complete search history.

(56) References Cited

U.S. PATENT DOCUMENTS 4,267,420 A * 5/1981 Brastad ..... 219/730
4,775,771 A 10/1988 Pawlowski
4,865,921 A 9/1989 Hollenberg
4,890,439 A 1/1990 Smart
4,925,684 A * 5/1990 Simon ..... 426/107
4,936,935 A 6/1990 Beckett
4,963,424 A 10/1990 Beckett
4,968,865 A * 11/1990 Seaborne et al. ..... 219/759
4,970,358 A 11/1990 Brandberg et al.
5,039,364 A 8/1991 Beckett
5,070,223 A * 12/1991 Colasante ..... 219/759
5,117,078 A 5/1992 Beckett
5,213,902 A 5/1993 Beckett
5,221,419 A 6/1993 Beckett
5,260,537 A 11/1993 Beckett
5,266,386 A 11/1993 Beckett
RE34,683 E 8/1994 Maynard
5,340,436 A 8/1994 Beckett
5,354,973 A 10/1994 Beckett
5,410,135 A 4/1995 Pollart
5,424,517 A 6/1995 Habeger (Continued)

FOREIGN PATENT DOCUMENTS

EP 0 356 169 A2 2/1990

(Continued)

*Primary Examiner*—Tu B Hoang
*Assistant Examiner*—Ket D Dang
(74) *Attorney, Agent, or Firm*—Womble Carlyle Sandridge & Rice, PLLC

(57) ABSTRACT

A microwave energy interactive web includes a reagent that is responsive to heat. The microwave energy interactive web may be used to form a package for heating a food item.

27 Claims, 7 Drawing Sheets

U.S. PATENT DOCUMENTS

| | | | |
|---|---|---|---|
| 5,519,195 | A | 5/1996 | Keefer |
| 5,628,921 | A | 5/1997 | Beckett |
| 5,672,407 | A | 9/1997 | Beckett |
| 5,759,422 | A | 6/1998 | Schmelzer |
| 5,800,724 | A | 9/1998 | Habeger |
| 6,114,679 | A | 9/2000 | Lai |
| 6,150,646 | A | 11/2000 | Lai |
| 6,204,492 | B1 | 3/2001 | Zeng |
| 6,251,451 | B1 | 6/2001 | Zeng |
| 6,414,290 | B1 | 7/2002 | Cole |
| 8,433,322 | | 8/2002 | Zeng |
| 6,455,827 | B2 | 9/2002 | Zeng |
| 6,552,315 | B2 | 4/2003 | Zeng |
| 6,677,563 | B2 | 1/2004 | Lai |
| 6,717,121 | B2 | 4/2004 | Zeng |
| 6,765,182 | B2 | 7/2004 | Cole |
| 7,019,271 | B2 | 3/2006 | Wnek |
| 2003/0111463 | A1 | 6/2003 | Lai |
| 2005/0173425 | A1 * | 8/2005 | Wnek et al. ..... 219/730 |
| 2006/0113300 | A1 | 6/2006 | Wnek |

FOREIGN PATENT DOCUMENTS

| | | | |
|---|---|---|---|
| GB | 2 207 589 | A | 2/1989 |
| JP | 2001-110562 | * | 4/2001 |
| WO | WO 03/066435 | A2 | 8/2003 |

* cited by examiner

THERMALLY ACTIVATABLE MICROWAVE INTERACTIVE MATERIALS

CROSS-REFERENCE TO RELATED APPLICATION

This application claims the benefit of U.S. Provisional Application. No. 60/671,267, filed Apr. 14, 2005, which is incorporated by reference herein in its entirety.

TECHNICAL FIELD

The present invention relates to a various materials for heating, browning, and/or crisping a food item, and particularly relates to various materials for heating, browning, and/or crisping a food item in a microwave oven.

BACKGROUND

Microwave ovens have become a principle form of heating food in a rapid and effective manner. Various attempts have been made to provide microwave food packages that produce effects associated with foods cooked in a conventional oven. Such packages must be capable of controlling the distribution of energy around the food item, utilizing the energy in the most efficient manner, and ensuring that the food item and the container provide a pleasant and acceptable finished food item.

To do so, many microwave food packages include one or more microwave energy interactive elements. A microwave interactive element may promote browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials ("microwave interactive materials") or segments arranged in a particular configuration to absorb microwave energy, transmit microwave energy, reflect microwave energy, or direct microwave energy in varying proportions, as needed or desired for a particular microwave heating container and food item. For example, portions of a food item may be shielded from microwave energy to prevent scorching or dehydrating, which may be particularly important for food items having a mass of greater than about 400 grams. Where surface browning and/or crisping is desired, a microwave energy interactive element that absorbs microwave energy may be used. Such an element becomes hot when exposed to microwave energy, thereby increasing the amount of heat supplied to the exterior of the food item.

Typically, the microwave interactive element is supported on a microwave inactive or transparent substrate for ease of handling and/or to prevent contact between the microwave interactive material and the food item. As a matter of convenience and not limitation, and although it is understood that a microwave interactive element supported on a microwave transparent substrate includes both microwave interactive and microwave inactive elements or components, such constructs may be referred to herein as "microwave energy interactive webs", "microwave interactive webs", or "webs".

While some microwave interactive webs are available commercially, there remains a need for improved materials that provide the desired level of heating, browning, and/or crisping of a food item in a microwave oven.

SUMMARY

In one aspect, the present invention is directed to the use of one or more additives, substances, or reagents that alter the heating characteristics of a microwave energy interactive element when exposed to microwave energy. In another aspect, the present invention is directed to various materials that may be used to modify the heating characteristics of a food item in a microwave oven.

More particularly, the present invention relates generally to a material that can be used to improve the heating, browning, and/or crisping of a food item in a microwave oven. In one aspect, the material comprises a susceptor material that conforms to the food item during microwave heating. In another aspect, the material comprises a microwave energy interactive insulating material. In still another aspect, the material comprises a durably expandable microwave energy interactive insulating material. According to various aspects of the invention, the microwave energy interactive insulating material provides improved heating, browning, and/or crisping of a food item heated adjacent thereto.

In one particular aspect, a microwave energy interactive web comprises a microwave energy interactive element including a microwave energy interactive material, and a reagent at least partially overlying the microwave energy interactive material. The reagent may comprise a substance that releases water upon exposure to thermal energy, one or more reagents that combine to generate a gas upon exposure to heat, or any combination thereof.

In another particular aspect, a microwave susceptor film comprises a microwave energy interactive material supported on a polymeric film, and a coating overlying at least a portion of the microwave energy interactive material, where the coating includes a substance that releases water upon exposure to heat. In one variation of this aspect, the microwave energy interactive material comprises indium tin oxide.

In yet another aspect, a microwave interactive insulating material comprises a susceptor film including a microwave energy interactive material supported on a first polymeric film layer, and a water-providing reagent overlying at least a portion of the microwave energy interactive material. A second polymeric film layer is joined to the water-providing reagent in a predetermined pattern, thereby forming at least one closed cell between the water-providing reagent and the second polymeric film layer. The closed cell or cells inflate in response to being exposed to microwave energy. The microwave energy interactive material comprises indium tin oxide, aluminum, or any other suitable material. In one variation, the water-providing reagent comprises a substance that releases water upon exposure to heat. The second polymeric film layer may be joined to the water-providing reagent using thermal bonding, adhesive bonding, mechanical bonding, or any suitable lamination, welding, or adhesive process.

In still another aspect, a durably expandable microwave interactive insulating material comprises a microwave energy interactive material supported on a first polymeric film layer, a second polymeric film layer joined to the microwave energy interactive material in a predetermined pattern, thereby forming at least one closed cell between the microwave energy interactive material and the second polymeric film layer, and a gas-releasing reagent overlying at least a portion of at least one of the microwave energy interactive material or the second polymeric film layer, adjacent the at least one closed cell. In one variation, the gas-releasing reagent may comprise at least one thermally-activated reagent. In another variation, the gas-releasing reagent comprises at least one blowing agent, for example, p-p'-oxybis(benzenesulphonylhydrazide), azodicarbonamide, p-toluenesulfonylsemicarbazide, or any combination thereof. In still another variation, at least one of the first polymeric film and the second polymeric film may be formed from a barrier material, for example, ethylene vinyl alcohol, a barrier nylon, polyvinylidene chloride, a barrier fluoropolymer, nylon 6, nylon 6,6, coextruded nylon 6/EVOH/nylon 6, silicon oxide coated film, barrier polyethylene terephthalate, or any combination thereof.

In another aspect, a durably expandable microwave interactive insulating material comprises a susceptor film comprising a microwave energy interactive material supported on a first polymeric film layer, a support layer superposed with the microwave energy interactive material, a second polymeric film layer joined to the support layer in a predetermined pattern, thereby forming at least one closed cell between the support layer and the second polymeric film layer, and a gas-generating coating overlying at least one of the support layer and the second polymeric film layer. The gas-generating coating may comprise at least one reagent that generates a gas, for example, carbon dioxide, in response to thermal energy. In one variation, the closed cell may inflate in response to the application of microwave energy to the insulating material. The closed cell may remain substantially inflated for at least about 1 minute after the application of microwave energy has ceased. As another example, the closed cell may remain substantially inflated for at least about 5 minutes after the application of microwave energy has ceased.

Additional aspects, features, and advantages of the present invention will become apparent from the following description and accompanying figures.

BRIEF DESCRIPTION OF THE DRAWINGS

The description refers to the accompanying drawings in which like reference characters refer to like parts throughout the several views, and in which.

DESCRIPTION

Figure 1A:
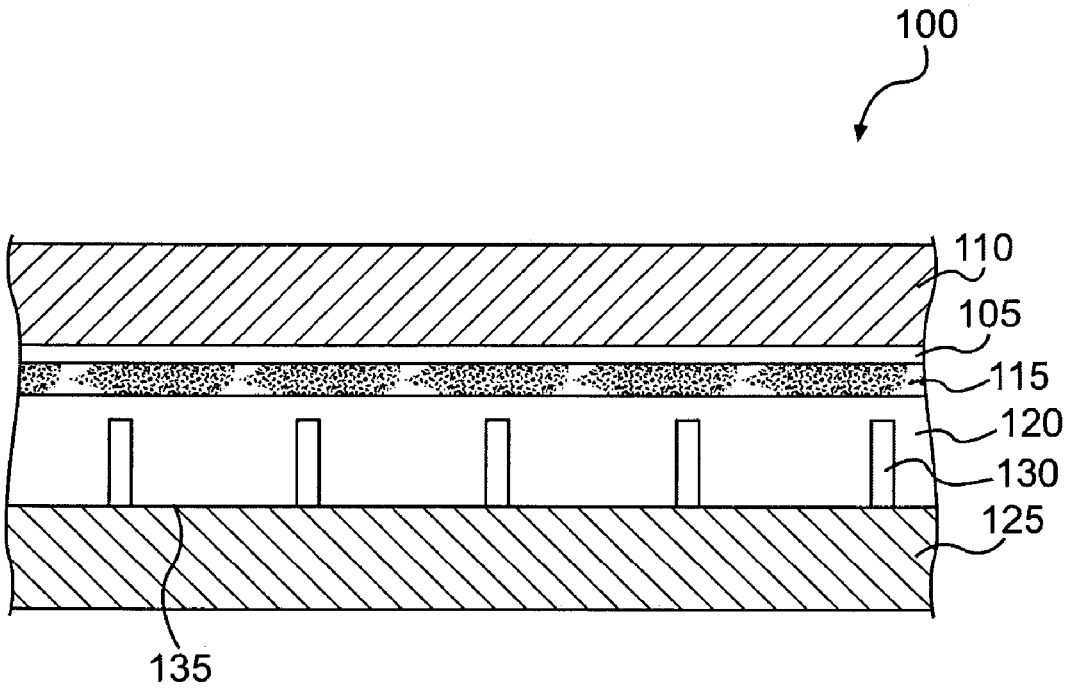
FIG. 1A PRIOR ART
FIG. 1A depicts an exemplary presently known microwave energy interactive insulating material.

According to various aspects of the invention, the heating characteristics of a microwave energy interactive web are altered through the use of one or more functional additives, substances, or reagents, optionally provided within a coating, that undergo a chemical transformation or reaction to release or produce a gas or other substance capable of becoming a gas. The reagent, the resulting gas, and the optional coating may serve one or more functions, depending on the heating characteristics of the microwave interactive web or structure in which the web is incorporated and the amount and type of reagent used.

In one aspect, the reagent directly or indirectly may provide dimensional stability to the web in the presence of thermal energy, or heat. Such a reagent may be thought of as a "heat stabilizing reagent". Commercially available microwave interactive webs often are prone to undesirable shriveling or melting upon exposure to microwave energy due to the rapid and substantial increase in temperature of the microwave energy interactive material. As a result, such webs often are joined at least partially to a supporting layer or material, or simply "support", for example, paper or paperboard, that provides dimensional stability to the microwave interactive web before, during, and after exposure to microwave energy. Unfortunately, however, use of a support inhibits the ability of the microwave interactive web to conform to the surface of a food item, thereby reducing the efficacy of the microwave interactive element. In sharp contrast, the reagents and coatings of the present invention render the microwave interactive web sufficiently stable upon exposure to thermal energy, or heat, such that no additional support is required, while optionally allowing the web to undergo a controlled shrinking process that brings the web into closer conformance with the food item. While no additional support layer is required, it will be understood that, in some circumstances, it may be desirable to use a support in conjunction with the various methods and materials of the present invention, and that such uses are contemplated hereby.

It will be understood that the degree that a microwave interactive web shrinks may depend on the reagent used, the coating weight, and the concentration of the coating, and numerous other factors. Thus, the amount of reagent and/or coating used for such an application may vary, depending on the desired degree of dimensional stability. Where greater, but controlled, shrink is desired, less reagent and/or coating may be used, as compared with an application in which little or no shrink is desired.

In another aspect, the reagent may promote the formation of three-dimensional structures that provide insulating characteristics or features to the web. Such a reagent may be thought of as a "insulation promoting reagent". One example of a three-dimensional structure that may be used in accordance with the present invention is a microwave energy interactive insulating material. As used herein, the term "microwave energy interactive insulating material" or "insulating material" refers any combination of layers of materials that is both responsive to microwave energy and capable of providing some degree of thermal insulation when used to heat a food item. Such materials may include expandable or inflatable cells that provide an insulating function when at least partially filled with a gas.

For purposes of simplicity and not by limitation, the various additives, reagents, and substances described herein or contemplated hereby sometimes may be referred to collectively herein using the term "reagent", regardless of how many reagents are used or their intended purpose or actual function in use. The reagent may be applied to or incorporated into the microwave interactive web as a component of a coating, if needed or desired. Thus, unless specified otherwise, it will be understood that the term "reagent" includes a reagent provided as a component of a coating. Such a coating also may provide functional benefits to the web, for example, dimensional stability, printability, barrier properties, and the like. In each aspect, by using a reagent and/or coating in accordance with the present invention, the microwave interactive web is able to undergo a controlled, purposeful, physical transformation that results in greater conformance to the surface of a food item and improved heating, browning, and/or crisping of thereof.

Numerous reagents are contemplated hereby. In one aspect, the reagent comprises a substance that releases or generates water or water vapor upon exposure to heat. As stated above, such materials may be applied alone or as a component of a coating to provide dimensional stability to a microwave interactive web in the presence of heat. While not wishing to be bound by theory, it is believed that the energy required to generate water vapor is drawn from the heated microwave energy interactive material, and further, that the resulting water vapor or other gas absorbs heat from the microwave energy interactive material, thereby preventing the microwave interactive web from scorching and shrinking undesirably.

As one example, the reagent may be a hydrated mineral, crystalline inorganic chemical with water of hydration, or natural mineral with water of hydration (collectively "hydrated solid" or "hydrated solids"), an occluded water material, an encapsulated water material, a water glass, or any combination thereof.

Any suitable hydrated solid may be used in accordance with the present invention. In one aspect, the hydrated solid may be selected so that the water of hydration is released at a temperature associated with microwave oven heating, for example, from about 100° C. to about 260° C. Furthermore, the hydrated solid also may be selected to have particular optical properties so that the resulting susceptor has a desired level of transparency or opacity. Examples of hydrated solids include, for example, hydrates of magnesium orthophosphates, calcium sulfate, aluminum hydroxide, calcium carbonate, silica gel, bentonites, gypsum, barium citrate, calcium citrate, and magnesium citrate, and any combination thereof. Specific examples of some hydrated solids include, but are not limited to, $Mg_3(PO_4)_2 \cdot 22H_2O$, $MgHPO_4 \cdot 3H_2O$, $Al(OH)_3 \cdot 3H_2O$, $CaCO_3 \cdot 6H_2O$, $Ba(C_6H_5O_7)_2 \cdot 7H_2O$, $Ca(C_6H_5O_7)_2 \cdot 4H_2O$, and $Mg(C_6H_5O_7)_2 \cdot 5H_2O$.

Alternatively, any suitable occluded water material may be used in accordance with the present invention, for example, various silica gels, clathrates, or any combination thereof, water glass ($Na_2O_xSiO_2$ x=3-5), water encapsulated by a polymer or other suitable material, or any combination thereof.

In another aspect, the reagent comprises one or more reagents that react to produce a gas in the presence of heat. For example, the reagent may comprise sodium bicarbonate ($NaHCO_3$) and a suitable acid. When exposed to heat, the reagents react to produce carbon dioxide. As another example, the reagent may comprise a blowing agent. Any suitable blowing agent may be used in any suitable amount needed to provide the desired level of cooling and resulting dimensional stability of the microwave interactive material. Examples of blowing agents that may be suitable include, but are not limited to, p-p'-oxybis(benzenesulphonylhydrazide), azodicarbonamide, and p-toluenesulfonylsemicarbazide. However, it will be understood that numerous other reagents and released gases are contemplated hereby.

Any of the various reagents may be applied to the microwave interactive element in any suitable manner, using any process, method, or technique. In one aspect, the reagent is coated onto the microwave interactive element as a component of a latex or other coating. Ideally, the latex is formulated to adhere sufficiently to the microwave energy interactive material, such that the resulting coating or film cannot be peeled or otherwise removed without using a solvent or without physically causing damage to the microwave energy interactive material. Additionally, a suitable latex ideally may be dried at a sufficiently low temperature and for a sufficiently short duration to ensure that the water of hydration, occluded water, encapsulated water, or other active component is not inadvertently driven off, and/or that any reagent or reagents do not react prematurely. Furthermore, a suitable latex ideally does not tend to etch, dissolve, corrode, or deactivate the microwave energy interactive material or the substrate. For example, depending on the microwave energy interactive material and the substrate used, the latex may have a pH of from about 5 to about 8. However, where the latex or the reagent does tend to degrade or deactivate the microwave interactive material, for example, as with some hydrates of sodium bicarbonate, a primer or other intermittent coating or layer may be used to shield the microwave energy interactive material from the latex or reagent. Examples of latexes that may be suitable for use with the present invention include, but are not limited to, acrylic copolymers, vinyl acetate copolymers, ethylene-vinyl acetate copolymers, and any combination of one or more thereof. Depending on the latex selected, the resulting film also may provide some degree of dimensional stability.

If desired, a binder may be used to enhance the stability of the latex and/or to achieve the desired process and product performance characteristics. Examples of binders that may be suitable binder include, but are not limited to, various ethylene vinyl acetate copolymers, for example, AIRFLEX 460, commercially available from Air Products, Inc., and various acrylic copolymer latexes, for example, ACRONAL 540, commercially available from BASF, Inc.

It will be understood that some reagents, for example, certain water absorbing polymers, fullers earth, and certain divalent minerals, may tend to cause the latex coagulate under some processing conditions. If desired, the reagent may be selected to avoid such processing challenges. For example, where a hydrated solid used as the reagent, the hydrated solid may be selected to have a solubility in water of less than about 0.08 g/L, for example, less than about 0.01 g/L, to minimize or eliminate such processing difficulties. Alternatively, one or more processing aids such as stabilizers, surfactants, or other dispersing agents may be added to the coating if needed or desired.

The reagent and the coating containing the reagent may be applied in any amount and may overlie all or a portion of microwave interactive web, as needed or desired for a particular application. For example, the coating may be applied to the microwave interactive web in an amount of from about 2 to about 25 pounds per 1000 square feet (lb/1000 sq. ft.) on a dry basis. In one aspect, the coating may be applied in an amount of from about 4 to about 22 lb/1000 sq. ft. In another aspect, the coating may be applied in an amount of from about 6 to about 20 lb/1000 sq. ft. In another aspect, the coating may be applied in an amount of from about 8 to about 18 lb/1000 sq. ft. In yet another aspect, the coating may be applied in an amount of from about 10 to about 15 lb/1000 sq. ft. In still another aspect, the coating may be applied in an amount of from about 12 to about 14 lb/1000 sq. ft. However, greater or lesser coating weights are contemplated hereby.

The coating may be applied in an amount of about 5 to about 80 weight % non-volatiles (wt. % NV) based on the weight of the microwave interactive web. In one aspect, the coating may be applied in an amount of 10 to about 70 wt. % NV based on the weight of the microwave interactive web. In another aspect, the coating may be applied in an amount of 20 to about 60 wt. % NV based on the weight of the microwave interactive web. In yet another aspect, the coating may be applied in an amount of 30 to about 50 wt. % NV based on the weight of the microwave interactive web. However, greater or lesser coating weights are contemplated hereby.

Numerous microwave interactive elements are contemplated for use in accordance with various aspects of the present invention. In one example, the microwave interactive element may comprise a thin layer of microwave interactive material that tends to absorb microwave energy, thereby generating heat at the interface with a food item. Such elements often are used to promote browning and/or crisping of the surface of a food item (sometimes referred to as a "browning and/or crisping element" or "suscepting element"). When supported on a film or other substrate, such an element may be referred to as a "susceptor" or "susceptor film". The susceptor film may be used to form all or a portion of a package that surrounds a food item during storage, transportation, and heating of a food item.

As another example, the microwave interactive element may comprise a foil having a thickness sufficient to shield one or more selected portions of the food item from microwave energy (sometimes referred to as a "shielding element"). Such shielding elements may be used where the food item is prone to scorching or drying out during heating.

The shielding element may be formed from various materials and may have various configurations, depending on the particular application for which the shielding element is used. Typically, the shielding element is formed from a conductive, reflective metal or metal alloy, for example, aluminum, copper, or stainless steel. The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil, such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element or "microwave energy directing element" that directs microwave energy to specific areas of the food item. Such foils also may be used in combination with browning and/or crisping elements, for example, susceptors.

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel—chromium—molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymeric film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

If desired, the microwave energy interactive element may include one or more discontinuities in the form of breaks or apertures. Such breaks or apertures may be sized and positioned to heat particular areas of the food item selectively. The number, shape, size, and positioning of such discontinuities may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void in the material used to form the construct, or may be a non-physical "aperture". A non-physical aperture may be a portion of the construct that is microwave energy inactive by deactivation or otherwise, or one that is otherwise transparent to microwave energy. Thus, the aperture may be a portion of the web formed without a microwave energy active material or, alternatively, may be a portion of the web formed with a microwave energy active material that has been deactivated. While both physical and non-physical apertures allow the food item to be heated directly by the microwave energy, a physical aperture also provides a venting function to allow steam or other vapors to escape from the food item.

As stated above, any of the above elements and numerous others contemplated hereby may be supported on a substrate. The substrate typically comprises an electrical insulator, for example, a polymeric film. The thickness of the film may typically be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymeric films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one aspect, the polymeric film may comprise polyethylene terephthalate (PET). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, commercially available from Toray Films (Front Royal, Va.), and QU50 High Barrier Coated PET, commercially available from Toray Films (Front Royal, Va.).

Polyethylene terephthalate films are used in commercially available susceptors, for example, the QWIKWAVE® Focus susceptor and the MICRORITE® susceptor, both available from Graphic Packaging International (Marietta, Ga.).

The polymeric film may be selected to impart various properties to the microwave interactive web, for example, printability, heat resistance, or any other property. As one particular example, the polymeric film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.).

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) as measuring using ASTM F1249 of less than about 100 $g/m^2/day$. In one aspect, the barrier film has a water vapor transmission rate (WVTR) as measuring using ASTM F1249 of less than about 50 $g/m^2/day$. In another aspect, the barrier film has a WVTR of less than about 15 $g/m^2/day$. In yet another aspect, the barrier film has a WVTR of less than about 1 $g/m^2/day$. In still another aspect, the barrier film has a WVTR of less than about 0.1 $g/m^2/day$. In a still further aspect, the barrier film has a WVTR of less than about 0.05 $g/m^2/day$.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item.

For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

As stated above, any of the various reagents may be used to form an enhanced microwave energy interactive insulating material ("insulating material"). The insulating material may include both microwave energy responsive or interactive components, and microwave energy transparent or inactive components.

In one aspect, the insulating material comprises one or more susceptor film layers in combination with one or more pre-formed expandable insulating cells. As the water vapor or other gas is released from the reagent, the expandable cells expand or inflate to create insulating cells or pockets. The reagent may be incorporated into the insulating material in any suitable manner and, in some instances, is coated as a component of a latex onto all or a portion of one or more layers adjacent to or in communication with the expandable cells. In contrast with presently available expandable cell insulating materials, no paper or paperboard layer is required either to provide the necessary water vapor to expand the cells or to provide dimensional stability during heating. However, such paper or paperboard layers may be included if desired. The insulating material also may include one or more additional microwave energy transparent or inactive materials to improve ease of handling the microwave energy interactive material, and/or to prevent contact between the microwave energy interactive material and the food item, provided that each is resistant to softening, scorching, combusting, or degrading at typical microwave oven heating temperatures, for example, at from about 100° C. to about 260° C.

Various aspects of the invention may be illustrated by referring to the figures. For purposes of simplicity, like numerals may be used to describe like features. It will be understood that where a plurality of similar features are depicted, not all of such features necessarily are labeled on each figure. Although several different exemplary aspects, implementations, and embodiments of the various inventions are provided, numerous interrelationships between, combinations thereof, and modifications of the various inventions, aspects, implementations, and embodiments of the inventions are contemplated hereby. In each of the examples shown herein, it should be understood that the layer widths are not necessarily shown in perspective. In some instances, for example, the adhesive layers may be very thin with respect to other layers, but are nonetheless shown with some thickness for purposes of clearly illustrating the arrangement of layers.

Figure 1B:
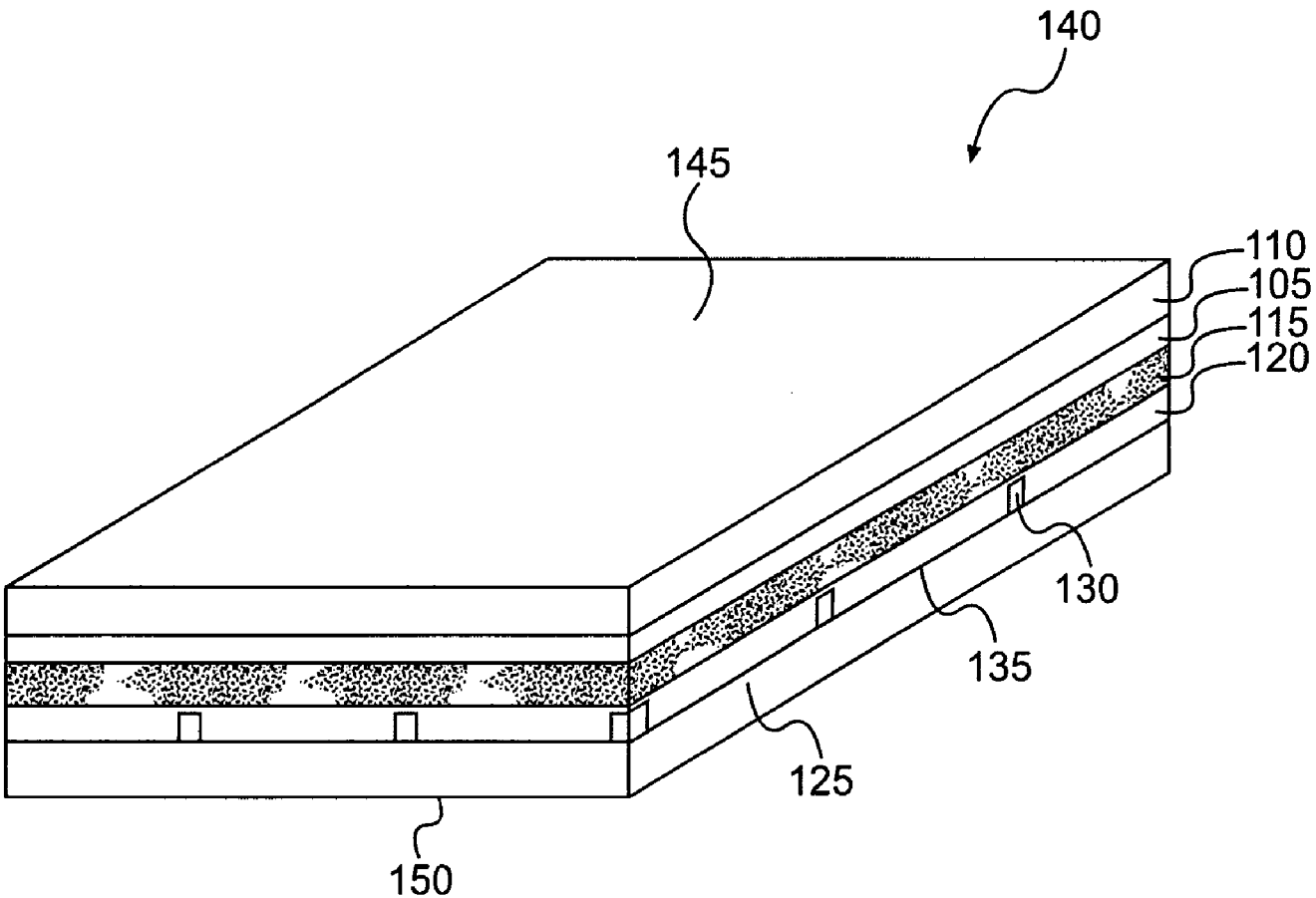
FIG. 1B PRIOR ART
FIG. 1B depicts the exemplary microwave energy interactive insulating material of FIG. 1A in the form of a cut insulating sheet.
Figure 1C:
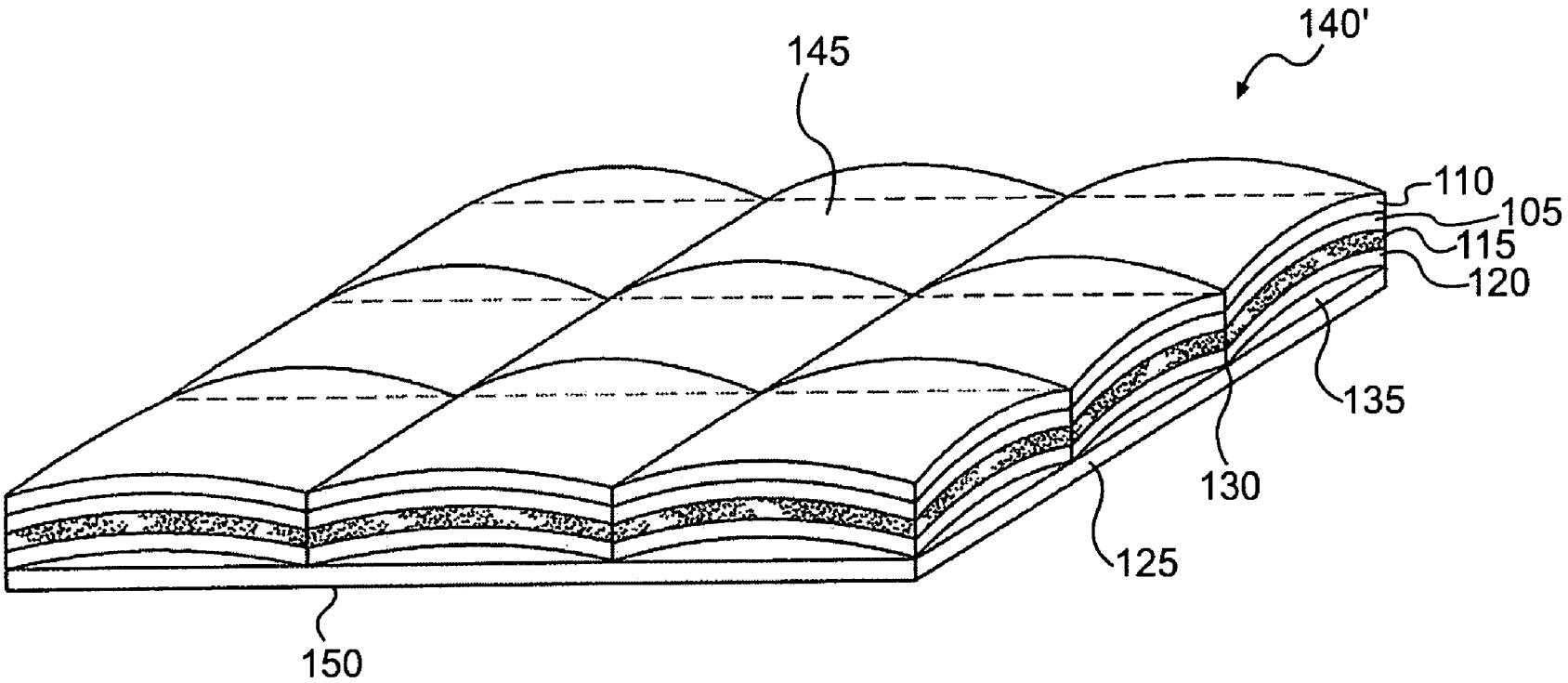
FIG. 1C PRIOR ART
FIG. 1C depicts the insulating sheet of FIG. 1B upon exposure to microwave energy.

One example of a presently known insulating material is illustrated in FIGS. 1A-1C. Referring to FIG. 1A, a thin layer of microwave energy interactive material 105 is supported on a first polymeric film 110 and bonded by lamination with an adhesive 115 to a dimensionally stable substrate 120, for example, paper. The substrate 120 is bonded to a second plastic film 125 using a patterned adhesive 130 or other material, such that closed cells 135 are formed in the material 100. The insulating material 100 may be cut and provided as a substantially flat, multi-layered sheet 140, as shown in FIG. 1B.

As the microwave energy interactive material 105 heats upon impingement by microwave energy, water vapor and other gases typically held in the substrate 120, for example, paper, and any air trapped in the thin space between the second plastic film 125 and the substrate 120 in the closed cells 135, expand, as shown in FIG. 1C. The cells 135 expand or inflate to form a quilted top surface 145 of pillows separated by channels (not shown) in the susceptor film 110 and substrate 120 lamination, which lofts above a bottom surface 150 formed by the second plastic film 125. The resulting insulating material 140' has a quilted or pillowed appearance. When microwave heating has ceased, the cells 135 typically deflate and return to a somewhat flattened state.

Figure 2A:
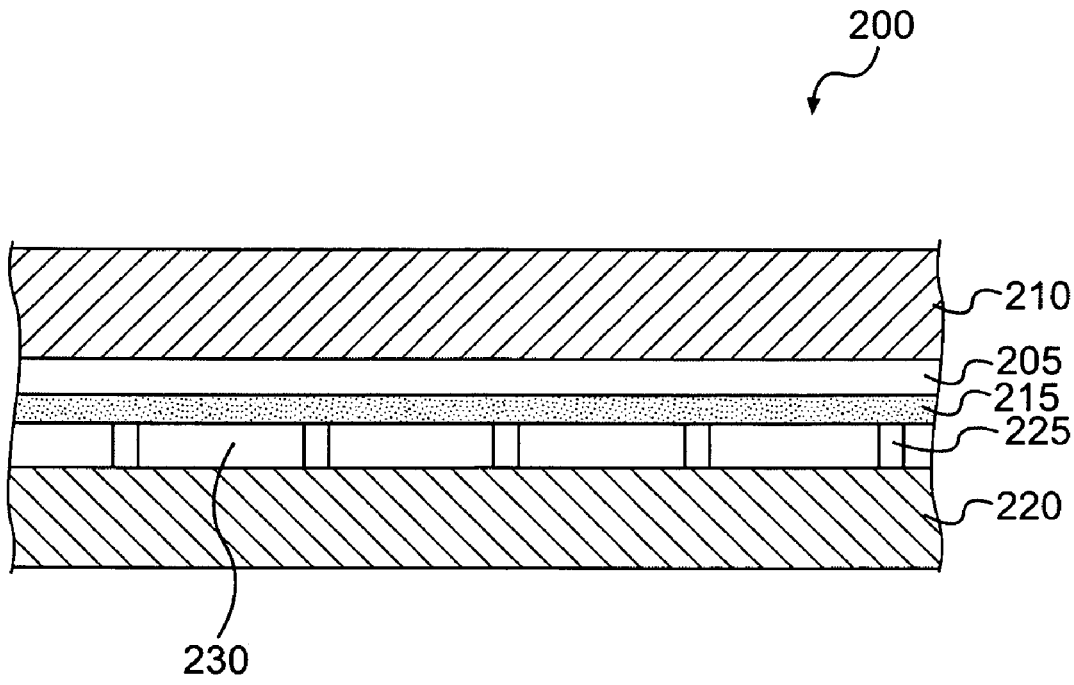
FIG. 2A depicts an exemplary microwave energy interactive insulating material according to various aspects of the present invention.
Figure 2B:
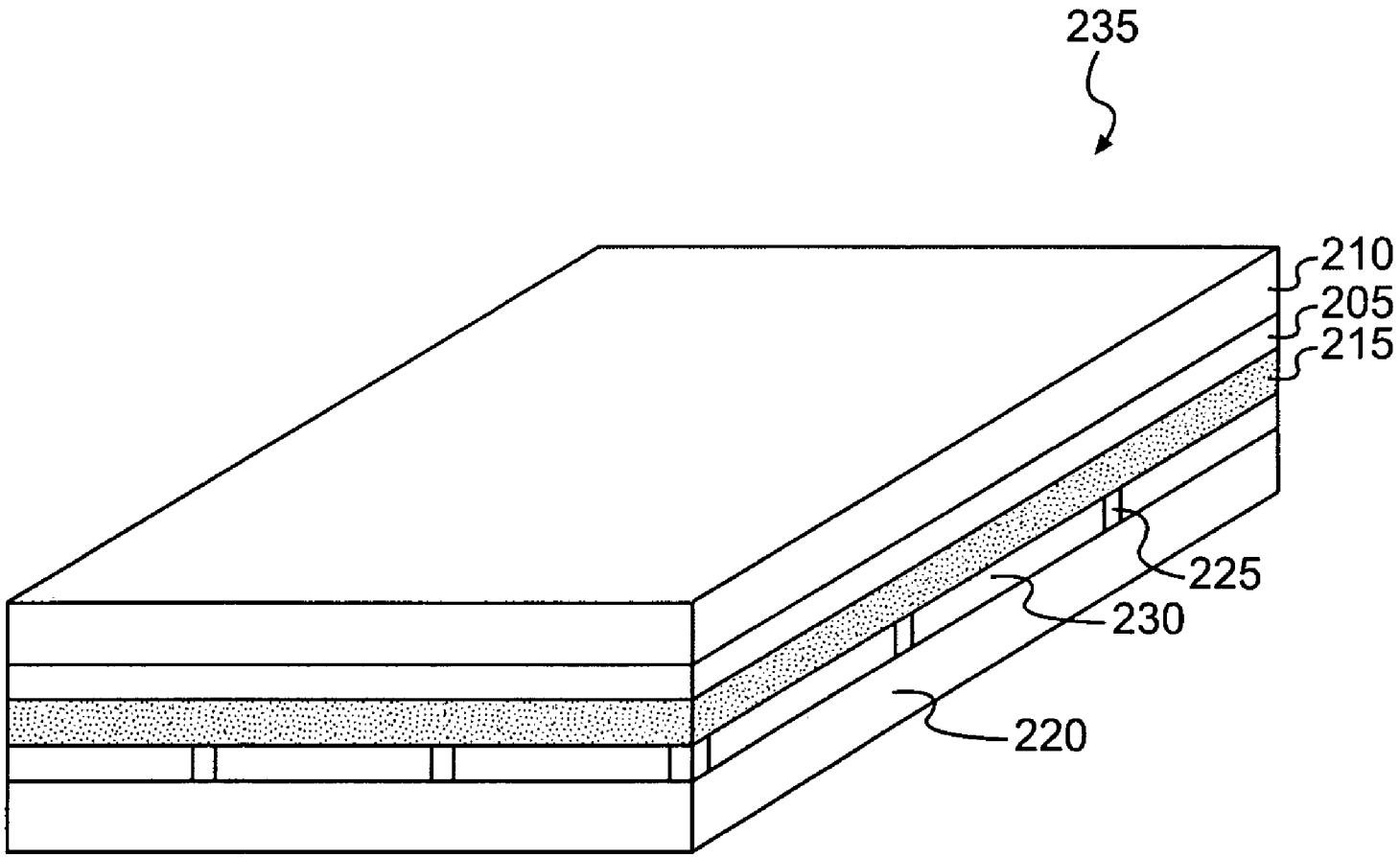
FIG. 2B depicts the exemplary microwave energy interactive insulating material of FIG. 2A in the form of a cut insulating sheet.

Turning now to FIGS. 2A-2D, an exemplary insulating material 200 formed according to the present invention is depicted. Referring to FIG. 2A, a thin layer of microwave interactive material 205 is supported on a first plastic film 210 to form a susceptor film. One or more reagents 215, optionally within a coating, overlies at least a portion of the layer of microwave interactive material 205. The reagent 215 is joined to a second plastic film 220 using a patterned adhesive 225 or other material, or using thermal bonding, ultrasonic bonding, or any other suitable technique, such that closed cells 230 (shown as a void) are formed in the material 200. The insulating material 200 may be cut into a sheet 235, as shown in FIG. 2B.

Figure 2C:
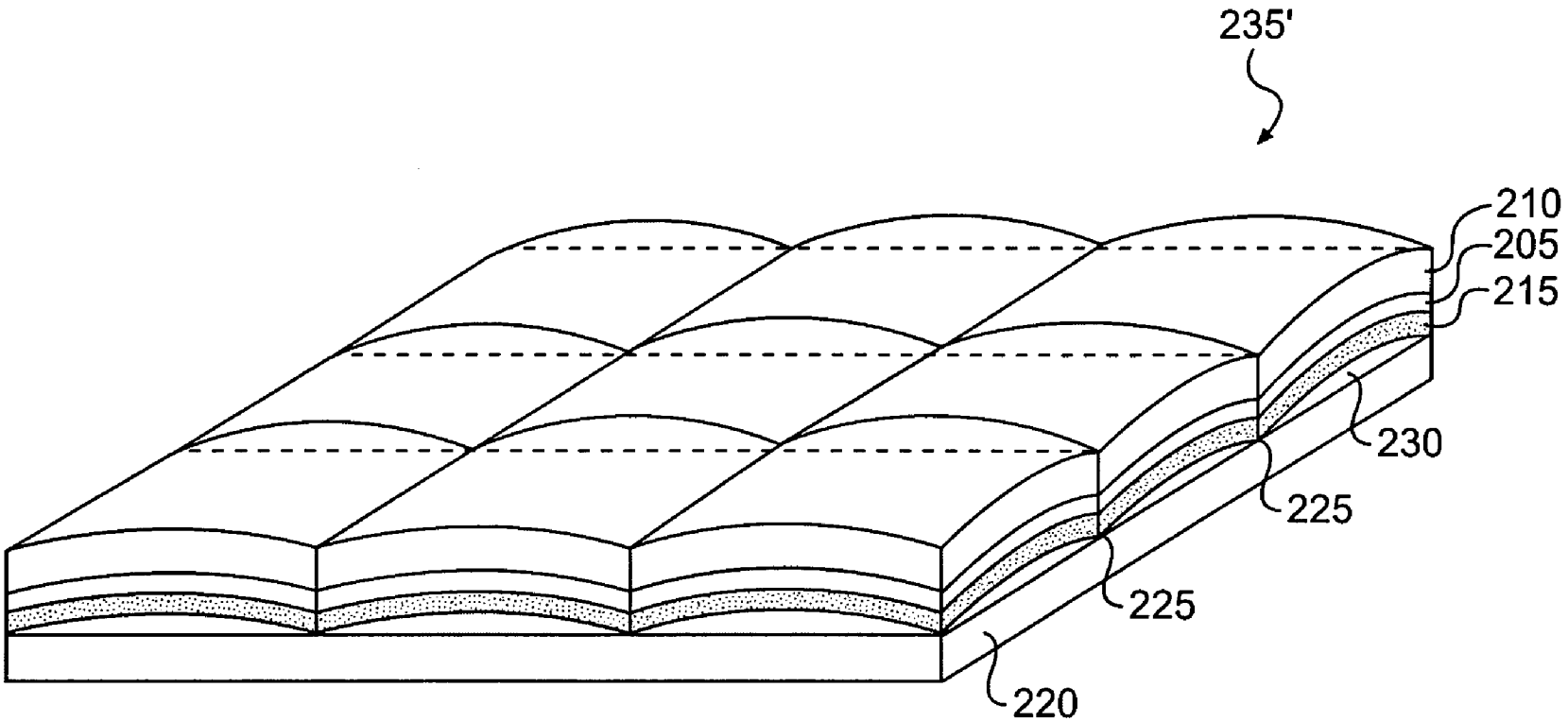
FIG. 2C depicts the insulating sheet of FIG. 2B upon exposure to microwave energy.

FIG. 2C depicts the exemplary insulating material 235 of FIG. 2B after being exposed to microwave energy from a microwave oven (not shown). As the microwave interactive material 205 heats upon impingement by microwave energy, water vapor or other gases are released from or generated by the reagent 215. The resulting gas applies pressure on the susceptor film 210 on one side and the second plastic film 220 on the other side of the closed cells 230. Each side of the material 200 forming the closed cells 230 reacts simultaneously, but uniquely, to the heating and vapor expansion to form a quilted insulating material 235'. This expansion may occur within 1 to 15 seconds in an energized microwave oven, and in some instances, may occur within 2 to 10 seconds. Although there is no paper or paperboard to provide dimensional stability, the water vapor resulting from the reagent is sufficient both to inflate the expandable cells and to absorb any excess heat from the microwave energy interactive material. When microwave heating has ceased, the cells or quilts may deflate and return to a somewhat flattened state, or may remain expanded, as will be discussed below.

Figure 2D:
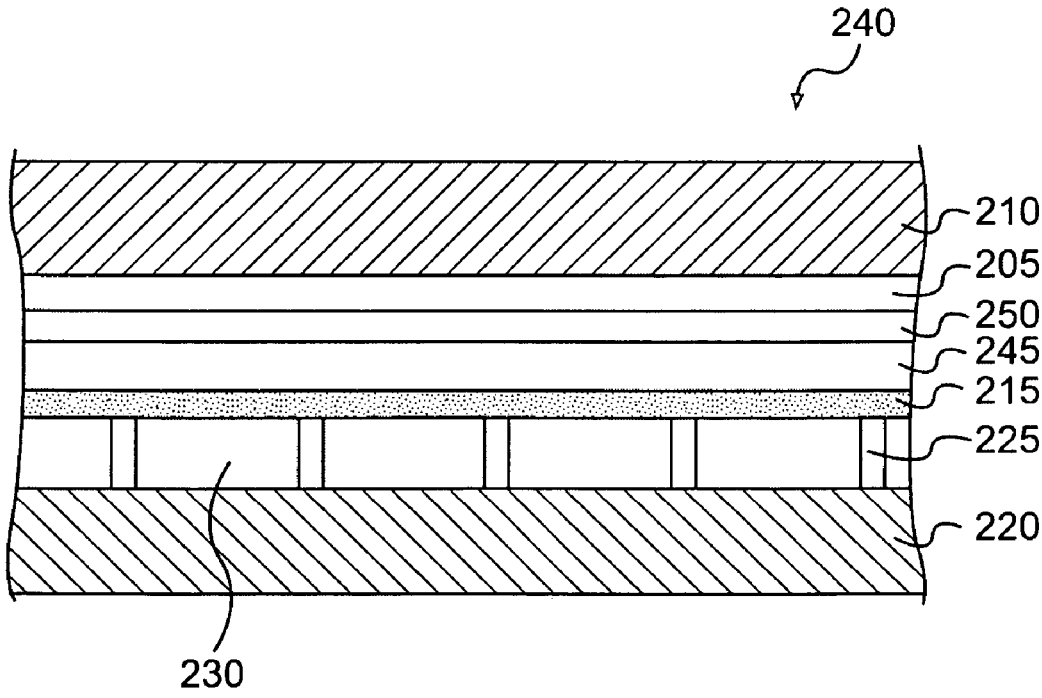
FIG. 2D depicts the material of FIG. 2A with a support layer.

As stated above, although a support layer is not required for dimensional stability or to provide a source of water vapor, it may be desirable to include a support layer for some applications. An example of such an insulating material 240 is shown in FIG. 2D. The insulating material 240 is similar to that illustrated in FIG. 2A, except that a support layer 245 formed from, for example, paper, is provided. The support layer 245 may be joined to the microwave energy interactive material 205 using a layer of adhesive 250, or using any other suitable technique. In this and other aspects, the reagent 215 may overlie at least a portion of the support layer 245, as shown, or may overlie the second polymeric film layer 220.

If desired, the insulating material may comprise a durably expandable microwave energy interactive insulating material. As used herein, the term "durably expandable microwave energy interactive insulating material" or "durably expandable insulating material" refers to an insulating material that includes expandable cells that tend to remain at least partially, substantially, or completely inflated after exposure to microwave energy has been terminated. Such materials may be used to form multi-functional packages and other constructs that can be used to heat a food item, to provide a surface for safe and comfortable handling of the food item, and to contain the food item after heating. Thus, a durably expandable insulating material may be used to form a package or construct that facilitates storage, preparation, transportation, and consumption of a food item, even "on the go".

In one aspect, a substantial portion of the plurality of cells remain substantially expanded for at least about 1 minute after exposure to microwave energy has ceased. In another aspect, a substantial portion of the plurality of cells remain substantially expanded for at least about 5 minutes after exposure to microwave energy has ceased. In still another aspect, a substantial portion of the plurality of cells remain substantially expanded for at least about 10 minutes after exposure to microwave energy has ceased. In yet another aspect, a substantial portion of the plurality of cells remain substantially expanded for at least about 30 minutes after exposure to microwave energy has ceased. It will be understood that not all of the expandable cells in a particular construct or package must remain inflated for the insulating material to be considered to be "durable". Instead, only a sufficient number of cells must remain inflated to achieve the desired objective of the package or construct in which the material is used.

For example, where a durably expandable insulating material is used to form all or a portion of a construct for storing a food item, heating, browning, and/or crisping the food item in a microwave oven, removing it from the microwave oven, and removing it from the construct, only a sufficient number of cells need to remain at least partially inflated for the time required to heat, brown, and/or crisp the food item and remove it from the microwave oven after heating. In contrast, where a durably expandable insulating material is used to form all or a portion of a construct for storing a food item, heating, browning, and/or crisping the food item in a microwave oven, removing the food item from the microwave oven, and consuming the food item within the construct, a sufficient number of cells need to remain at least partially inflated for the time required to heat, brown, and/or crisp the food item, remove it from the microwave oven after heating, and transport the food item until the food item and/or construct has cooled to a surface temperature comfortable for contact with the hands of the user.

Any of the durably expandable insulating materials of the present invention may be formed at least partially from one or more barrier materials, for example, polymeric films, that substantially reduce or prevent the transmission of oxygen, water vapor, or other gases from the expanded cells. Examples of such materials are described above. However, the use of other materials is contemplated hereby.

It will be understood that the various insulating materials of the present invention enhance heating, browning, and crisping of a food item in a microwave oven. First, the water vapor, air, and other gases contained in the closed cells provides insulation between the food item and the ambient environment of the microwave oven, thereby increasing the amount of sensible heat that stays within or is transferred to the food item. Additionally, the formation of the cells allows the material to conform more closely to the surface of the food item, placing the susceptor film in greater proximity to the food item, thereby enhancing browning and/or crisping. Furthermore, insulating materials may help to retain moisture in the food item when cooking in the microwave oven, thereby improving the texture and flavor of the food item. Additional benefits and aspects of such materials are described in PCT Application No. PCT/US03/03779, U.S. application Ser. No. 10/501,003, and U.S. application Ser. No. 11/314,851, each of which is incorporated by reference herein in its entirety.

Any of the insulating materials described herein or contemplated hereby may include an adhesive pattern or thermal bond pattern that is selected to enhance cooking of a particular food item. For example, where the food item is a larger item, the adhesive pattern may be selected to form substantially uniformly shaped expandable cells. Where the food item is a small item, the adhesive pattern may be selected to form a plurality of different sized cells to allow the individual items to be variably contacted on their various surfaces. While several examples are provided herein, it will be understood that numerous other patterns are contemplated hereby, and the pattern selected will depend on the heating, browning, crisping, and insulating needs of the particular food item.

If desired, multiple layers of insulating materials may be used to enhance the insulating properties of the insulating material and, therefore, enhance the browning and crisping of the food item. Where multiple layers are used, the layers may remain separate or may be joined using any suitable process or technique, for example, thermal bonding, adhesive bonding, ultrasonic bonding or welding, mechanical fastening, or any combination thereof. In one example, two sheets of an insulating material may be arranged so that their respective susceptor film layers are facing away from each other. In another example, two sheets of an insulating material may be arranged so that their respective susceptor film layers are facing towards each other. In still another example, multiple sheets of an insulating material may be arranged in a like manner and superposed. In a still further example, multiple sheets of various insulating materials are superposed in any other configuration as needed or desired for a particular application.

Various aspects of the present invention are illustrated by the following examples, which are not to be construed in any way as imposing limitations upon the scope thereof. On the contrary, it is to be clearly understood that resort may be had to various other aspects, modifications, and equivalents thereof which, after reading the description herein, may be suggested to one of ordinary skill in the art without departing from the spirit of the present invention.

EXAMPLE 1

A reagent-containing coating was prepared by dispersing about 0.2 g SURFYNOL 440 surfactant, about 44 g aluminum hydroxide trihydrate, and about 27 g $CaSO_4$ in about 110 g water. Next, 27 g of a mixture of 3 parts AIRFLEX 460 vinyl acetate latex and 1 part ACRONAL 540 acrylic latex (BASF, Inc.) was added to the above mixture under mild agitation. The resulting coating then was applied to the metallized side of an aluminum-coated polyethylene terephthalate film at a rate of 45 dry lb/3000 $ft^2$. A sample then was placed in a 1000 watt microwave oven and heated at 100% power for 5 sec. The amount of water released from the susceptor was 5.8 lb/3000 $ft^2$.

EXAMPLE 2

A reagent-containing coating was prepared by adding 38 g of ATRFLEX 460 ethylene vinyl acetate latex to 26 g water, followed by adding under mild agitation 36 g of magnesium hydrogen phosphate trihydrate. The coating was applied to aluminum side of a polyethylene phthalate susceptor film in an amount of 20 lb/3000 $ft^2$. A sample was placed in a 1000 watt microwave oven and heated at 100% power for 3 sec. A water release of about 1.2 lb/3000 $ft^2$ was observed. Another sample was placed in a 1000 watt microwave oven and heated at 100% power for 5 sec. A water release of about 2.3 lb/3000 $ft^2$ was observed.

EXAMPLE 3

Various other reagent-containing coatings were prepared and evaluated. A summary of the results is presented in Table 1.

TABLE 1

| Sample | Reagent | Ratio | Binder | Coating weight (lb/1000 sq. ft.) | Reagent coat weight (lb/1000 sq. ft). | Shrinkage (%) |
|---|---|---|---|---|---|---|
| 3-1 | CaSO4 | 1 | 48% Acronal | — | — | — |
| 3-2 | $CaSO_4$: $Al(OH)_3$ | 0.2:0.48 | Acronal | 54 | 37.0 | <5 |
| 3-3 | $CaSO_4$: $Al(OH)_3$: $Mg_2(PO_4)_3$ | 2:1:1 | Acronal | 40.5 | 31.0 | 10 |
| 3-4 | $Al(OH)_3$: $Mg_2(PO_4)_3$ | 0.57:0.43 | Airflex 460 | 48.6 | 35.8 | 14 |
| 3-5 | $Al(OH)_3$: $Mg_2(PO_4)_3$ | 0.57:0.43 | Airflex 460 | 22 | 16.0 | 42 |
| 3-6 | $Al(OH)_3$: $Mg_2(PO_4)_3$ | 0.57:0.43 | Acronal | 17.7 | 13.4 | 21 |
| 3-7 | $CaSO_4$: $Al(OH)_3$ | 0.59:0.41 | 50/50 Airflex/Acronal | 42.2 | 28.5 | 28 |
| 3-8 | $CaSO_4$: $Al(OH)_3$ | 0.38:0.62 | 50/50 Airflex/Acronal | 36 | 28.8 | 39 |
| 3-9 | $CaSO_4$: $Al(OH)_3$ | 0.56:0.44 | Airflex 460 | 39 | 27.3 | 24 |

EXAMPLE 4

Additional evaluations were conducted on the expandable cell material of Example 2. The material of Example 2 was laminated to a layer of clear, heat-sealable SKC SL-10 polyethylene terephthalate in a quilt pattern having an about 0.25 inch border with about 0.5 square inch cells. The cells were formed using thermal bonding and the border was formed using adhesive bonding with Basic Adhesives BR-3482 PVA.

Several samples were subjected to a cell-burst test. The test involved: (1) cutting out an area containing 8×8 quilt pockets for 64 total; (2) taping the sample to the non-clay side of SBS; (3) taping the corners down to reduce the amount of film shrinkage and to allow easier counting; (4) heating the samples in a microwave oven on 'High' power for 5 seconds (enough to allow the quilts to inflate); and (6) counting the number of cells that remain intact (i.e., the cells that did not burst beyond the adhesive borders into other quilt cells). No food item was used.

After 5 seconds, all 64 squares had inflated and were still intact. Typical numbers for similar expandable cell material with paper were from about 16 to about 29 of 64 remained intact. After an additional 10 seconds in the microwave, the insulating material started to exhibit a bit of charring, film damage, and shrinkage.

EXAMPLE 5

A pouch was formed from the insulating material of Example 2. A commercially available 4.0 ounce frozen handheld, dough-enrobed pizza product was inserted into the pouch. The edges were heat-sealed and the product in the pouch was heated in a microwave oven on High for about 2 minutes. The following observations were made: (1) the material shrank around the food product; (2) the cells inflated to the outside more than to the inside of the pouch; (3) the food was browned, crisp, and very hot; and (4) the interior of the pouch was intact, with little to no susceptor cracking or flaking. The quilting was readily visible on the top surface of the pouch.

EXAMPLE 6

The material formed in Example 3 was used to form a heat sealed pouch. A pizza product similar to that described in Example 5 was placed inside. The edges were heat-sealed and the product in the pouch was heated in a microwave oven and heated. Again, the pizza product was browned, crisped, and fully heated. For comparison, another pizza product was heated in the standard susceptor sleeve provided with the food item. The performance of the experimental pouch was comparable, if not better than, the sleeve provided with the pizza product.

EXAMPLE 7

Evaluations were conducted as in Example 6, except that a 6 inch diameter frozen pizza was used as the food item. The pizza was successfully prepared, with the crust being browned and crisp.

EXAMPLE 8

A coating that releases carbon dioxide upon exposure to microwave energy was evaluated. About 50 g starch was dispersed in about 500 g water and cooked for about 10 min. at about 212° F. About 10 g baking powder and about 3 g baking soda then was added. About 2 tablespoons of the composition was spread with a brush on the inside of a polypropylene pouch. After the coating dried, a pouch was formed. The pouch was placed in a microwave oven and heated for about 2 minutes. The pouch inflated and remained inflated even after the pouch was no longer exposed to microwave energy and was allowed to cool.

Although certain embodiments of this invention have been described with a certain degree of particularity, those skilled in the art could make numerous alterations to the disclosed embodiments without departing from the spirit or scope of this invention. Any directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention as defined in the appended claims. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention.

What is claimed is:

1. A heat stabilized microwave energy interactive insulating material comprising: a susceptor film comprising a substantially continuous layer of microwave energy interactive material supported on a first polymer film, the microwave energy interactive material being operative for generating heat in response to microwave energy; a second polymer film joined to the layer of microwave energy interactive material in a predetermined pattern that defines at least one closed cell between the layer of microwave energy interactive material and the second polymer film; and a water-providing reagent disposed between the layer of microwave energy interactive material and the second polymer film, the water-providing reagent being operative for releasing water vapor and inflating the closed cell in response to heat from the microwave energy interactive material, wherein the heat stabilized microwave energy interactive insulating material is devoid of paper, such that the water-providing reagent is not bound within paper.

2. The insulating material of claim 1, wherein the microwave energy interactive material comprises indium tin oxide.

3. The insulating material of claim 1, wherein the microwave energy interactive material comprises aluminum.

4. The insulating material of claim 1, wherein the water-providing reagent is a hydrated solid, an occluded water material, an encapsulated water material, a water glass, or any combination thereof.

5. The insulating material of claim 1, wherein the second polymer film is joined to the non-paper based layer using thermal bonding.

6. The insulating material of claim 1, wherein the second polymer film is joined to the non-paper based layer using adhesive bonding.

7. A durably expandable microwave interactive insulating material comprising: a microwave energy interactive material supported on a first polymer film layer, the microwave energy interactive material being operative for generating heat in response to microwave energy; a second polymer film layer joined to the microwave energy interactive material in a predetermined pattern, thereby forming at least one closed cell between the microwave energy interactive material and the second polymer film layer; and a gas-releasing reagent overlying at least a portion of at least one of the microwave energy interactive material and the second polymer film layer adjacent to the closed cell, the gas-releasing reagent being operative for releasing a gas in response to heat from the microwave energy interactive material, the gas being for inflating the closed cell, wherein the gas-releasing reagent is not bound within a layer of paper, wherein at least one of the first polymer film and the second polymer film comprises a barrier material adapted to maintain the closed cell in an inflated condition after exposure to microwave energy has ceased.

8. The insulating material of claim 7, wherein the gas-releasing reagent comprises at least one blowing agent.

9. The insulating material of claim 8, wherein the blowing agent is p-p'-oxybis(benzenesulphonylhydrazide), azodicarbonamide, p-toluenesulfonylsemicarbazide, or any combination thereof.

10. The insulating material of claim 7, wherein the first polymer film and the second polymer film each comprise a barrier material.

11. The insulating material of claim 10, wherein the barrier material is selected from the group consisting of ethylene vinyl alcohol, a barrier nylon, polyvinylidene chloride, a barrier fluoropolymer, nylon 6, nylon 6,6, coextruded nylon 6/EVOH/nylon 6, silicon oxide coated film, barrier polyethylene terephthalate, and any combination thereof.

12. The insulating material of claim 7, wherein the closed cell remains substantially inflated for at least about 1 minute after the application of microwave energy has ceased.

13. The insulating material of claim 12, wherein the closed cell remains substantially inflated for at least about 5 minutes after the application of microwave energy has ceased.

14. The insulating material of claim 7, wherein the microwave energy interactive material is selected from the group consisting of aluminum and indium tin oxide.

15. A durably expandable microwave interactive insulating material comprising: a susceptor film comprising a substantially continuous layer of microwave energy interactive material supported on a first polymer film, the microwave energy interactive material being operative for converting at least a portion of impinging microwave energy into heat; a support layer joined to the layer of microwave energy interactive material; a second polymer film joined to the support layer in a predetermined pattern, thereby forming at least one closed cell between the support layer and the second polymer film; and a gas-generating coating overlying at least one of the support layer the second polymer film, the gas-generating coating being operative for generating a gas in response to heat from the microwave energy interactive material, the gas being for inflating the closed cell, wherein the gas-generating coating is not bound within a layer of paper, wherein at least one of the first polymer film and the second polymer film comprises a barrier material adapted to maintain the closed cell in an inflated condition after exposure to microwave energy has ceased.

16. The insulating material of claim 15, wherein the first polymer film and the second polymer film each comprise a barrier material.

17. The insulating material of claim 15, wherein the barrier material is selected from the group consisting of ethylene vinyl alcohol, a barrier nylon, polyvinylidene chloride, a barrier fluoropolymer, nylon 6, nylon 6,6, coextruded nylon 6/EVOH/nylon 6, silicon oxide coated film, barrier polyethylene terephthalate, and any combination thereof.

18. The insulating material of claim 15, wherein the gas is carbon dioxide.

19. The insulating material of claim 15, wherein the closed cell remains substantially inflated for at least about 1 minute after the application of microwave energy has ceased.

20. The insulating material of claim 15, wherein the closed cell remains substantially inflated for at least about 5 minutes after the application of microwave energy has ceased.

21. The insulating material of claim 1, wherein the water-providing reagent is selected from the group consisting of a hydrated mineral, a crystalline inorganic chemical with water of hydration, a natural mineral with water of hydration, and any combination thereof.

22. The insulating material of claim 1, wherein the water-providing reagent is selected from the group consisting of hydrates of magnesium orthophosphates, calcium sulfate, aluminum hydroxide, calcium carbonate, silica gel, bentonites, gypsum, barium citrate, calcium citrate, and magnesium citrate, and any combination thereof.

23. The insulating material of claim 1, wherein the water-providing reagent is selected from the group consisting of $Mg_3(PO_4)_2.22H_2O$, $MgHPO_4.3H_2O$, $Al(OH)_3.3H_2O$, $CaCO_3.6H_2O$, $Ba(C_6H_5O_7)_2.7H_2O$, $Ca(C_6H_5O_7)_2.4H_2O$, and $Mg(C_6H_5O_7)_2.5H_2O$.

24. The insulating material of claim 1, wherein the water-providing reagent comprises an occluded water material selected from the group consisting of silica gels, clathrates, and any combination thereof.

25. The insulating material of claim 1, wherein the water-providing reagent comprises a water glass having the formula:

$$(Na_2O_xSiO_2\ x=3\text{-}5),$$

where x is from about 3 to about 5.

26. The insulating material of claim 1, wherein the water-providing reagent comprises one or more substances that combine to generate a gas upon exposure to heat.

27. The insulating material of claim 26, wherein the substances comprise sodium bicarbonate and an acid.

* * * * *